United States Patent [19]

Gleman

[11] Patent Number: 4,522,437

[45] Date of Patent: Jun. 11, 1985

[54] LOG LOADING TOOL

[76] Inventor: Jon F. Gleman, 6470 SW. 83rd St., Miami, Fla. 33143

[21] Appl. No.: 72,410

[22] Filed: Sep. 4, 1979

[51] Int. Cl.[3] ..... A47J 49/00

[52] U.S. Cl. ..... 294/9

[58] Field of Search ..... 294/9, 10, 14, 49, 55, 294/51, 53.5, 59, 54

[56] References Cited

U.S. PATENT DOCUMENTS

| | | | |
|---|---|---|---|
| 57,759 | 9/1866 | Pfeifer | 294/55 |
| 85,425 | 12/1868 | Brewer | 294/14 |
| 573,597 | 12/1896 | Iwan | 294/49 |
| 1,493,766 | 5/1924 | Reimer | 294/49 |
| 1,829,002 | 10/1931 | Gillogly | 294/55 |
| 2,572,230 | 10/1951 | Williams | 294/55 |
| 4,194,778 | 3/1980 | Hodnett | 294/9 |

*Primary Examiner*—James B. Marbert

[57] ABSTRACT

The invention relates to a chute shaped tool having a handle and an integral stop attached thereto, all of which is made of noncombustible material except, in some instances, for the wooden handle. The chute portion of the tool may be placed into the firebox of a typical woodburner stove or furnace for the purpose of guiding and physically supporting the loading of wooden logs or other similar solid fuels thereby assisting the stove user in the proper restoking of the fire and maintaining a safe bodily distance from hot stove surfaces. The integral stop rests against the firebox door thereby preventing the tool from completely entering the firebox during the fuel loading process. The chute further prevents damage to the firebox grate or firebrick by preventing dropped logs from impacting upon said firebox grate or firebrick. The tool also achieves greater ease in the manual loading of heavy awkward logs, otherwise held by one end only, by providing support to the far end of the log or its entire length thereby acting as a slide or chute.

1 Claim, 5 Drawing Figures

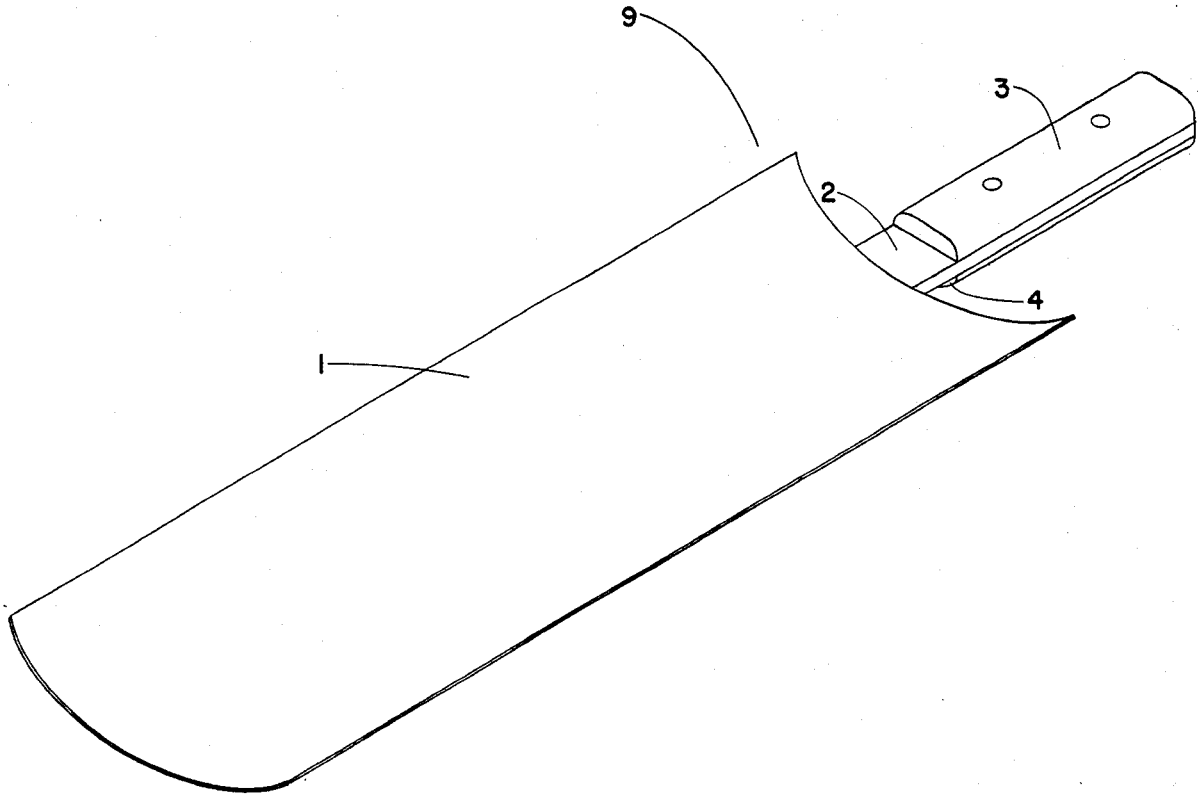
Fig. No. 1

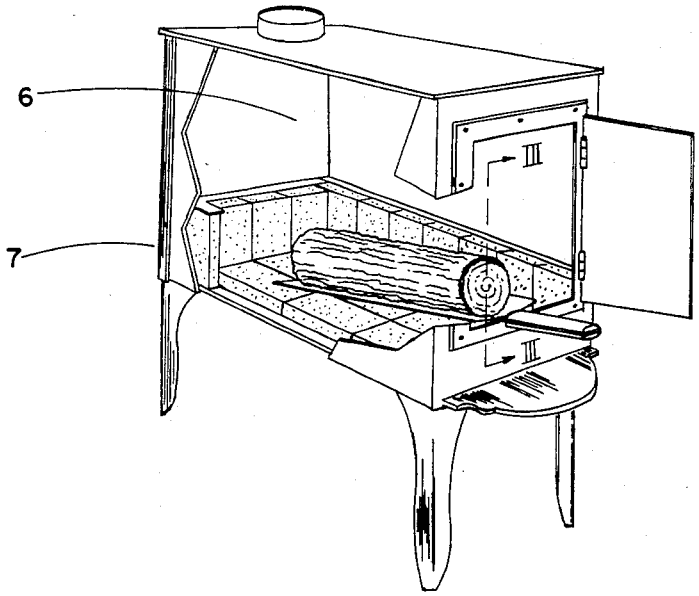
Fig. No. 2
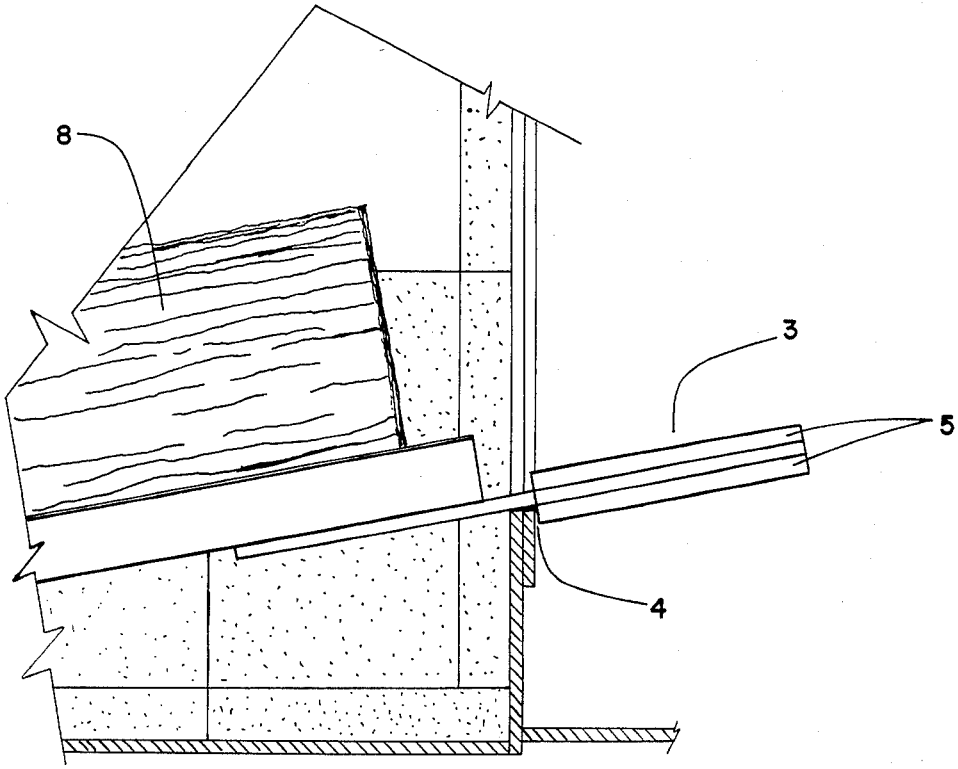
Fig. No. 3

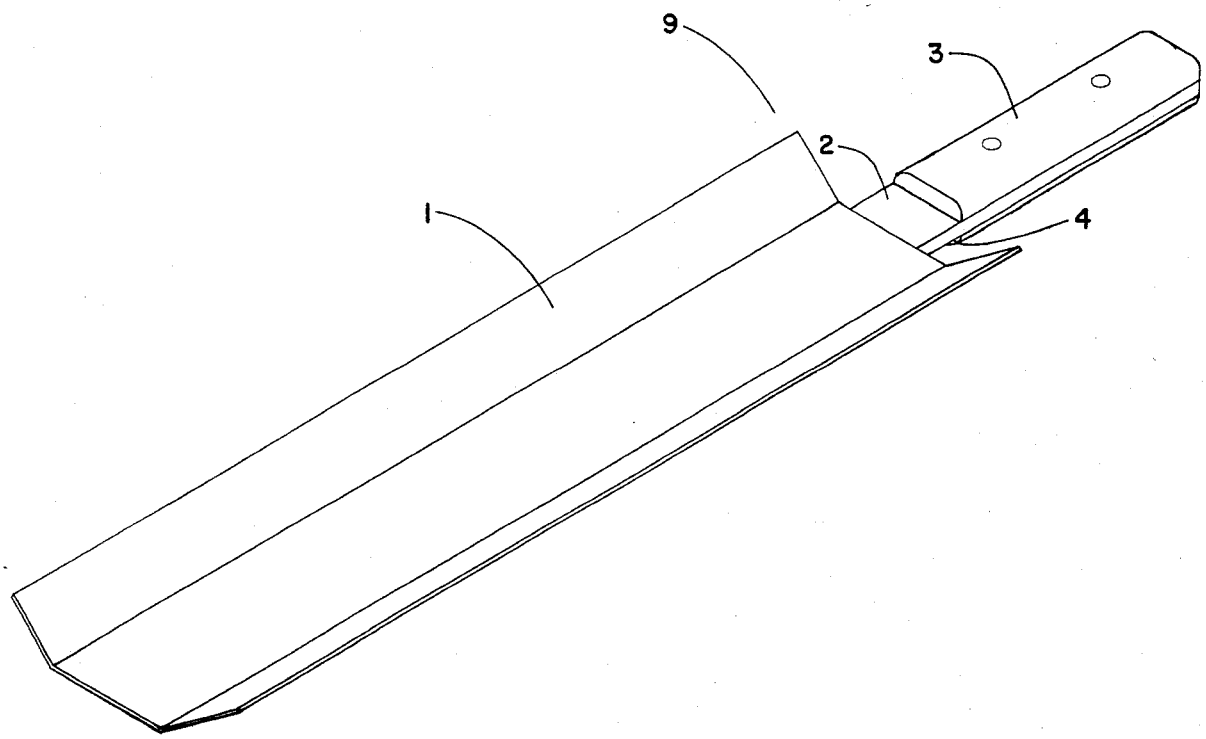
Fig. No. 4

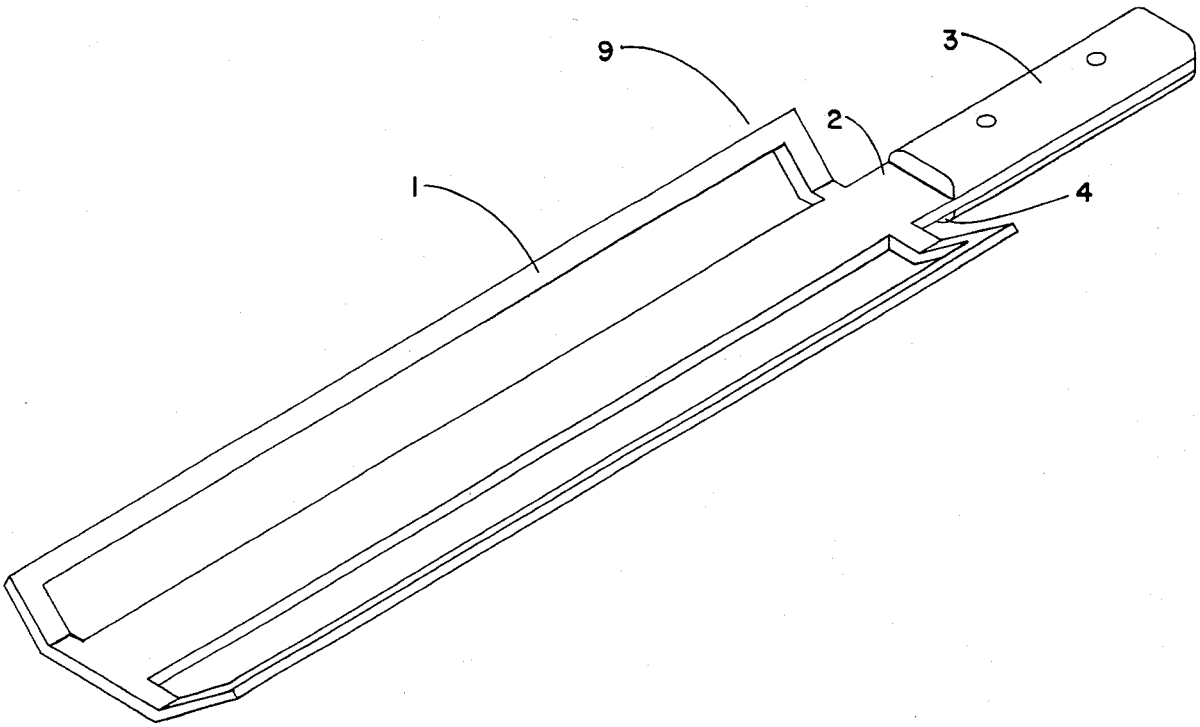
Fig. No. 5

LOG LOADING TOOL

BACKGROUND OF THE INVENTION

As a result of the recent energy crises, there has been a proliferation of domestic woodburning stoves. A majority of these stoves require the fuel, in the form of wooden logs, to be loaded axially (that is, with the motion of the log parallel to the long axis of the log) into the firebox through a small firebox door opening. Such stoves and loading of stoves will be referred to as "end-loading" in contradistinction to "front-loading" (as for example a fireplace) for the purposes of this patent.

A severe problem exists in the loading of logs into hot end-loading stoves, as it is difficult to support the logs properly while manually holding them by one end only. Two frequent results of this problem are that either the logs are thrown into the firebox with almost inevitable damage to the firebrick and/or grate, or the person loading the stove manually supports the log by hand all the way into the firebox, occasionally sustaining burns from the hot stove body and/or flames. It is thus apparent that a need exists for a device (to be used in conjunction with woodburning stoves) to assist in the loading of fuel while providing increased protection to the stove and the stove user. No such device presently exists.

The present invention overcomes the aforesaid difficulties by providing a rigid chute of suitable dimensions to fit inside the firebox door and allow the stove user to slide firewood along the chute into the firebox, keeping hands and arms away from the hot stove. The chute is subsequently withdrawn. The chute is provided with a handle to permit placing it and retrieving it from the firebox, and the handle also acts as a stop to prevent the device from slipping or falling into the firebox.

SUMMARY OF THE INVENTION

This invention is used as follows:

1. The firebox door of the woodburner stove is opened and the chute portion of the invention is placed into the firebox with the handle resting on and against the lower rim of the firebox door opening and, at the same time, protruding from the firebox opening thereby maintaining a safe and comfortable distance between the user's hand(s) and the hot firebox.

2. One end of a log is placed upon the chute and slid entirely into the firebox, consequently resting entirely upon the chute.

3. The chute is withdrawn from under the log and out of the firebox, thus gently lowering the log onto the grate, firebrick or on top of other fuel.

4. Finally the firebox door is closed.

Several important objectives of this invention are to provide a means of assisting the manual loading of logs and other solid fuels into end-loading woodburning stoves, to reduce the probability of damage to the stove and to reduce the probability of injury and discomfort to the stove user.

Other objectives and advantages of this invention will become apparent from the following description and accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown. The drawings also include two modified forms of the invention for the purpose of illustrating such possible modified forms. The invention (in a preferred form) is shown on the drawings wherein:

FIG. 1 is a perspective view showing the invention.

FIG. 2 is a perspective view showing a woodburning stove or furnace with the invention in use.

FIG. 3 is a view along the section line III—III in FIG. 2.

FIG. 4 is a perspective view showing a modified form of the invention shown in FIG. 1.

FIG. 5 is a perspective view showing a second modified form of the invention shown in FIG. 1.

DETAILED DESCRIPTION OF THE DRAWINGS

Referring to the drawings in detail, wherein like numerals indicate like elements, there is shown in FIG. 1 a portable log loading assist tool in accordance with the preferred embodiment of the present invention designated generally as 9. The portable log load assist tool generally includes a tang 2 and a handle 3.

The reference numeral 1 designates the chute of the portable log load assist tool to which is connected, either by welding, riveting or other mechanical means, a tang 2 that, in turn, is connected to and becomes a part of the handle 3. The preferred assembly of the handle 3 is accomplished by the method of gluing and riveting together the tang 2 and the insulating grip blocks 5.

The chute 1 is preferably made from 16 or 18 gauge sheet metal bent or formed into the desired configuration so as to form a slide defining the chute 1, having preferred overall dimensions of approximately $6\frac{1}{2}''$ in width and 18" in length. The tang 2 is preferably fabricated of bar stock teel approximately $\frac{1}{4}'' \times 1\frac{1}{2}''$ in cross-sectional dimensions with a total overall length (including the integral assembly with the chute 1 and the handle 3) of approximately $11\frac{1}{2}''$.

The handle of the portable log loading assist tool 9 is preferably fabricated from an assembly of the tang 2 and two heat insulating grip blocks 5 (preferably hardwood as shown in FIG. 3) fastened by riveting and gluing. The grip blocks 5 being so formed as to provide a preferred handle 3 upon assembly with the tang 2 of contoured and symmetrical configuration. The handle being approximately $1\frac{1}{2}''$ in width, $5\frac{1}{2}''$ in length and 1" in depth with curved contoured surfaces as indicated in the drawings.

The integral stop 4, which is also formed as a result of the assembly of the grip blocks 5 and the tang 2 provides a method of preventing the entire portable log loading assist tool 9 from being carried or pushed into the firebox 6 of the woodburner stove 7 while a log 8 is being slid down the chute portion 1 of the portable log loading assist tool 9 and into the firebox 6, said prevention being accomplished by the integral stop 4 resting against the rim of the open firebox door of the woodburner stove 7. The stop 4 having preferred dimensions of approximately $1\frac{1}{2}''$ in width and $\frac{1}{4}''$ in height.

In general, there are two primary methods by which a typical stove user consciously restokes woodburner stoves. One such method is for the stove user to literally "throw" the log into the firebox of the woodburner stove in an effort to avoid severe burns and/or discomfort which too frequently occur from contact with or sustained close proximity to the open firebox door area during the log loading process. The other method is for the stove user to attempt to position the log properly in the firebox and, upon experiencing extreme heat from the active firebox, drops the log. Both of these methods fail to satisfactorily load and position the logs within the firebox and both methods often result in damage to the firebox grating and/or brick, if not also burning the user in the process.

The primary advantages of the portable log loading assist tool 9 of this invention are that it provides a physical support and guide for the log(s) 8 being loaded into the woodburner stove 7 thereby eliminating the need for the stove user to hold or otherwise stabilize the tool 9. Both of the stove user's hands are, therefore, freed for manipulation of the log(s) 8 which, in turn, allows for greater ease and control in the log loading process, said ease and control being accomplished by said tool reducing the stove user's task from a combination effort of support, guiding, placing or "pushing" and lowering logs into the woodburner's firebox to simply pushing the log along the tool into the firebox once placed upon said tool. All other functions are accomplished in a remote fashion via said tool's handle.

The present invention may be embodied in other specific forms, materials and fabrication methods without departing from the spirit or essential attributes thereof and, accordingly, reference should be made to the appended claims, rather than to the foregoing specification as indicating the scope of the invention.

I claim:

1. A method for loading a log or the like into the firebox of an end-loading stove comprising:

inserting a log loading tool into the stove;

placing the log onto said log loading device;

sliding the log into the firebox;

removing said log loading tool from the stove.

* * * * *